US005436434A

United States Patent [19]

Baird

[11] Patent Number: 5,436,434

[45] Date of Patent: Jul. 25, 1995

[54] SPLATTER GUARD DEVICE FOR MICROWAVE OVENS

[76] Inventor: Grant L. Baird, 1650 S. Kendall St., Lakewood, Colo. 80232

[21] Appl. No.: 194,080

[22] Filed: Feb. 9, 1994

[51] Int. Cl.[6] ..... H05B 6/80

[52] U.S. Cl. ..... 219/734; 219/763; 219/732; 99/DIG. 14; 99/444

[58] Field of Search ..... 219/734, 735, 732, 733, 219/729, 762, 763; 126/299 C, 39 M; 99/425, 427, 444, DIG. 14

[56] References Cited

U.S. PATENT DOCUMENTS

| | | | |
|---|---|---|---|
| 4,037,581 | 7/1977 | Trifiletti | 126/39 M |
| 4,117,825 | 10/1978 | Robertson | 126/29 |
| 4,329,557 | 5/1982 | Staats | 219/763 |
| 4,343,978 | 8/1982 | Kubiatowicz | 219/732 |
| 4,345,133 | 8/1982 | Cherney et al. . | |
| 4,481,392 | 11/1984 | Nibbe et al. . | |
| 4,567,341 | 1/1986 | Brown . | |
| 4,577,092 | 3/1986 | Lenoir | 219/354 |
| 4,721,140 | 1/1988 | Coker . | |
| 4,748,308 | 5/1988 | Drews | 219/763 |
| 4,795,056 | 1/1989 | Meyers . | |
| 4,797,523 | 1/1989 | Kohnen . | |
| 4,801,773 | 1/1989 | Hanlon . | |
| 4,818,832 | 4/1989 | Fukumoto | 219/763 |
| 4,847,461 | 7/1989 | Gilmore | 219/763 |
| 4,904,834 | 2/1990 | Bowen | 219/726 |
| 4,924,049 | 5/1990 | Dexter, jr. | 219/734 |

*Primary Examiner*—Philip H. Leung
*Attorney, Agent, or Firm*—Carl Schaukowitch

[57] ABSTRACT

A splatter guard device is adapted for use inside a cooking chamber of a conventional microwave oven to inhibit splattering of cooking foodstuffs about the cooking chamber. The splatter guard device comprises a cover and a support structure. The cover is sized to extend longitudinally and laterally within the cooking chamber of the microwave oven to at least cover the cooking foodstuffs. The support structure is adapted to be secured in a manner within the cooking chamber of the microwave oven so that the support structure is operative to releasably retain the cover above and proximate to the cooking foodstuffs to inhibit splattering of the cooking foodstuffs about the cooking chamber.

11 Claims, 4 Drawing Sheets

SPLATTER GUARD DEVICE FOR MICROWAVE OVENS

FIELD OF THE INVENTION

The present invention broadly relates to devices which are used inside a cooking chamber of a conventional microwave oven to inhibit splattering of foodstuffs cooking therein. More particularly, the present invention concerns a splatter guard device which covers foodstuffs while cooking in a cooking chamber of a microwave oven to inhibit splattering of the cooking foodstuffs thereabout.

BACKGROUND OF THE INVENTION

For decades, people living in contemporary residences have prepared food by cooking it on a gas stove or an electric range. Only recently, the microwave oven has reduced the need to rely upon gas and electric heat to cook food. The microwave oven which has become a popular kitchen appliance for preparing foods uses radiant energy as its heat source. It is believed that microwave ovens have become popular because microwave cooking is fast and easy. Further, the energy requirements to cook in a microwave oven is much less than gas or electric cooking and, therefore, is less expensive. However, a problem arises when using microwaves to cook food. Because microwave energy heats food on a molecular level, hot spots can be generated on and within the cooking food. Sometimes these hot spots become so hot that minute, local explosions of the food occur. These local explosions cause cooking food particles to splatter about the cooking chamber. The advent of microwave ovens has spawn a need for accessories which could help make microwave cooking even faster and easier. Many of these accessories are oriented to minimize the soiling of the microwave cooking chamber that is often created as a result of food particles splattering thereabout.

U.S. Pat. No. 4,801,773 to Hanlon discloses a protective cover for a dish being heated in a microwave oven. The protective cover is formed of a moisture-absorbent, microwave transparent material as a top cover and an encircling wall depending downwardly for the periphery of the top cover to completely cover the dish to protect the cooking chamber of the oven from any possible splattering of food particles during heating. The protective cover is formed of absorbent material so that any escaping fluids and food particles may be captured or absorbed thereby. The protective cover may be treated with a microwave-safe resin to increase the rigidity of the protective cover. Although the protective cover is simple, safe and inexpensive to use, it is designed to be disposed after one use. If further microwave cooking is required, another protective cover could be used or the one originally covering the cooking food could be re-used although it might be sufficiently soiled resulting in soiling of the microwave oven.

U.S. Pat. No. 4,797,523 to Kohnen teaches a cover for an open container having contents which are to be heated in a microwave oven. The cover is fabricated from a cellulose hydrate film and includes a plurality of ventilation holes. The cover is moistened so that it adheres to the open container. Immediately before placing the cover onto the open container, the cellulose hydrate must be moisten so that the cover can adhere to the open container. Without moistening the cover, it is possible that the cover can be blown down into the container or blown off the container by air currents produced by a conventional fan within the microwave oven. This cover also appears to be the type which should be disposed after a single use or otherwise the used cover can soil the microwave oven.

U.S. Pat. No. 4,721,140 to Coker reveals a cover device for preventing splatters during the heating of food. The cover device is adapted to cover a container or plate of food during heating, especially in a microwave oven. The cover device is formed as a sheet of open weave material, preferably polyester, and a plurality of plastic weight elements are secured to the peripheral margin of the sheet. Because of its flexible construction, the cover device can cover a variety of differently shaped containers including open plates containing food. Even with direct contact with food, the cover device does not taint the food. The cover is also readily cleanable by washing it by hand, in a dishwasher or in a washing machine. However, when this cover device directly contacts the food on one plate, another cover would be appropriate for covering a different type of food on another plate.

U.S. Pat. No. 4,795,056 to Meyers discloses a microwave dish cover which closes an open container. The cover is elongated and has two opposite narrow ends and two opposite elongated ends. The cover is attached to the container by a latching means positioned at the narrow ends. The container itself must include an outwardly extending lip positioned on the upper edge thereof so that an inwardly extending protrusion of the latching means can engage the lip to lock the cover onto the container. The cover is fabricated from a material so that the cover can be deformed. Deforming the cover in the elongate direction unlocks the cover from the container. A disadvantage of using this microwave dish cover is that it is dedicated to the container operably compatible therewith.

Accordingly, there is a need for an improved splatter guard device which can act as a cover for a variety of open containers including plates that are currently used for cooking in microwave ovens. Some prior art covers directly contact the food cooking within the microwave oven. Removing the food temporarily from the microwave oven to check for appropriate temperature requires removal of these types of covers which can cause a mess. There is a further need to provide such a splatter guard device that avoids contact with the cooking food to prevent the possibility of food contamination. There is a further need for such a splatter guard device which can be readily cleaned of food particles splattered thereon so that it can be reused immediately thereafter. There is a further need for a splatter guard device which can be retrofitted into existing microwave ovens or incorporated into future models of microwave ovens.

SUMMARY OF THE INVENTION

It is an object of the present invention to provide a new and useful splatter guard device for microwave ovens that can cover a variety of open containers including plates that are currently being employed to cook food therein so that splattering of food particles about the cooking chamber is inhibited.

It is a further object of the present invention to provide a splatter guard device for microwave ovens that avoids direct contact with the cooking food so that the same cover can be used to cover numerous open containers of food sequentially placed into the microwave oven for cooking.

It is another object of the present invention to provide a splatter guard device that is easy to install into existing microwave ovens.

Yet another object of the present invention is to provide a splatter guard device that is simple and fast to clean for immediate subsequent use, if desired.

Still a further object of the present invention is to provide a splatter guard device that can easily be retrofitted into existing microwave ovens without making any physical modifications thereto.

Yet another object of the present invention is to provide a splatter guard device that can be easily built into future models of microwave ovens.

According to the present invention, a splatter guard device for microwave ovens is described which is adapted for use inside a cooking chamber of a conventional microwave oven to inhibit splattering of cooking foodstuffs about the cooking chamber. The cooking chamber is defined by a pair of opposite side walls, a rear wall, a inner door surface of a closed front door, a ceiling and a floor. In its broadest form, the splatter guard device includes a cover and a support structure. The cover, fabricated from a material transparent to microwaves, is sized to extend longitudinally and laterally within the cooking chamber of the microwave oven to at least cover the cooking foodstuffs. The support structure, also fabricated from a material transparent to microwaves, is adapted to be secured in a manner within the cooking chamber of the microwave oven so that the support structure is operative to releasably retain the cover above and proximate to the cooking foodstuffs to inhibit splattering of the cooking foodstuffs about the cooking chamber.

The cover is substantially flat and is preferably a unitary piece. The cover has a thickness and is defined by an outer peripheral edge portion adapted to be releasably retained by the support structure. It is preferred that the cover include a tongue element projecting outwardly from the outer peripheral edge portion and adapted to be removably inserted into the support structure so that the cover is disposed substantially horizontally within the cooking chamber of the microwave oven. Alternatively, the cover includes an inner flexible panel surrounded by and connected to a rigid outer frame structure. The outer frame structure is adapted to be releasably retained by the support structure and the inner flexible material can be either screen material transparent to microwaves or paper material such as paper towel material.

As a first exemplary embodiment of the present invention, the support structure is a body member. The body member has an array of slots extending laterally and substantially parallel to each other and facing into the cooking chamber of the microwave oven so that the cover can be releasably inserted into a select one of the array of slots. It is preferred that the body member include a pair of arms oppositely disposed on and movably connected to an upper portion of the body member so that the pair of arms are operative to extend between an anchor position and a detached position. In the anchor position, the body member is mounted within the cooking chamber. In the detached position, the body member is removable from the cooking chamber. It is also preferred that the body member include a pair of legs which connect to a lower portion of the body member and are adapted to elevate the body member within the cooking chamber.

The body member of the first exemplary embodiment of the present invention includes a pair of shoulders projecting from and connected to an upper portion of the body member to define a T-shape. Each of the shoulders is adapted to matably receive a respective one of the arms and each of the shoulders has a pair of opposite end portions. Each end portion has a threaded hole extending therethrough. Each of the arms includes a threaded shaft and a cup element connected to a distal end of the threaded shaft. Each of the threaded shafts is formed to matably engage a respective one of the threaded holes of the end portions of the shoulders. Upon rotating the arms in a fastening direction, the arms extend into the anchoring position so that each of the cup elements engages a respective one of opposite side walls of the cooking chamber of the microwave oven. Upon rotating the arms in a detaching direction opposite the fastening direction, the arms retract into the detached position thus disengaging the cup elements from respective opposite side walls.

For the first exemplary embodiment of the present invention, the body member also includes a pair of pillar portions. The pair of pillar portions project toward an inner door surface and extending vertically along the body member. Each of the pillar portions is disposed on either side of the slots to form a tapering guide for inserting the cover into a select one of the array of slots and is operative to contact a respective one of a pair of bracing segments depending downwardly from the outer peripheral edge portion of the cover.

As a second exemplary embodiment of the present invention, the support structure is the rear wall of the cooking chamber with an array of slots formed thereinto. The array of slots extend laterally and substantially parallel to each other and face into the cooking chamber of the microwave oven so that the cover can be releasably inserted into a select one of the array of slots.

As a third exemplary embodiment of the present invention, the support structure is a belt and pulley assembly. The belt and pulley assembly includes a pair of mounting blocks, a pair of pulleys, a continuous belt operably interconnecting the pulleys and a U-shaped retaining element. Each of the mounting blocks has a respective pulley rotatably connected thereto. The continuous belt is connected to the U-shaped retaining element extending into the cooking chamber. The U-shaped retaining element is operative to releasably retain the cover within the cooking chamber so that the cover can be vertically positioned at a select location between the pair of pulleys. It is preferred that the belt and pulley assembly is mounted behind the rear wall of the cooking chamber.

BRIEF DESCRIPTION OF THE DRAWINGS

Other objects, advantages and capabilities of the present invention will become more apparent as the description proceeds, taken in conjunction with the accompanying drawings, in which.

DESCRIPTION OF THE EXEMPLARY EMBODIMENTS

Figure 1:
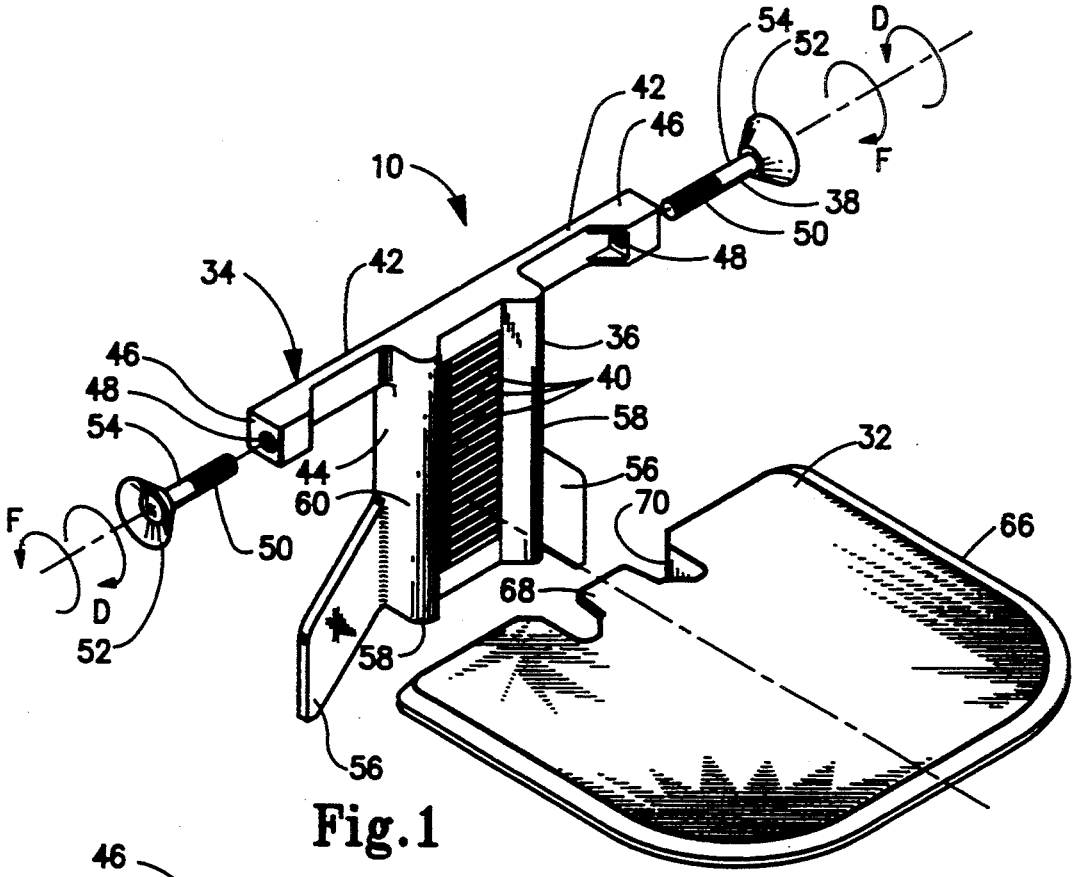
FIG. 1 is an exploded perspective view of a splatter guard device of a first exemplary embodiment of the present invention for a microwave oven.
Figure 2:
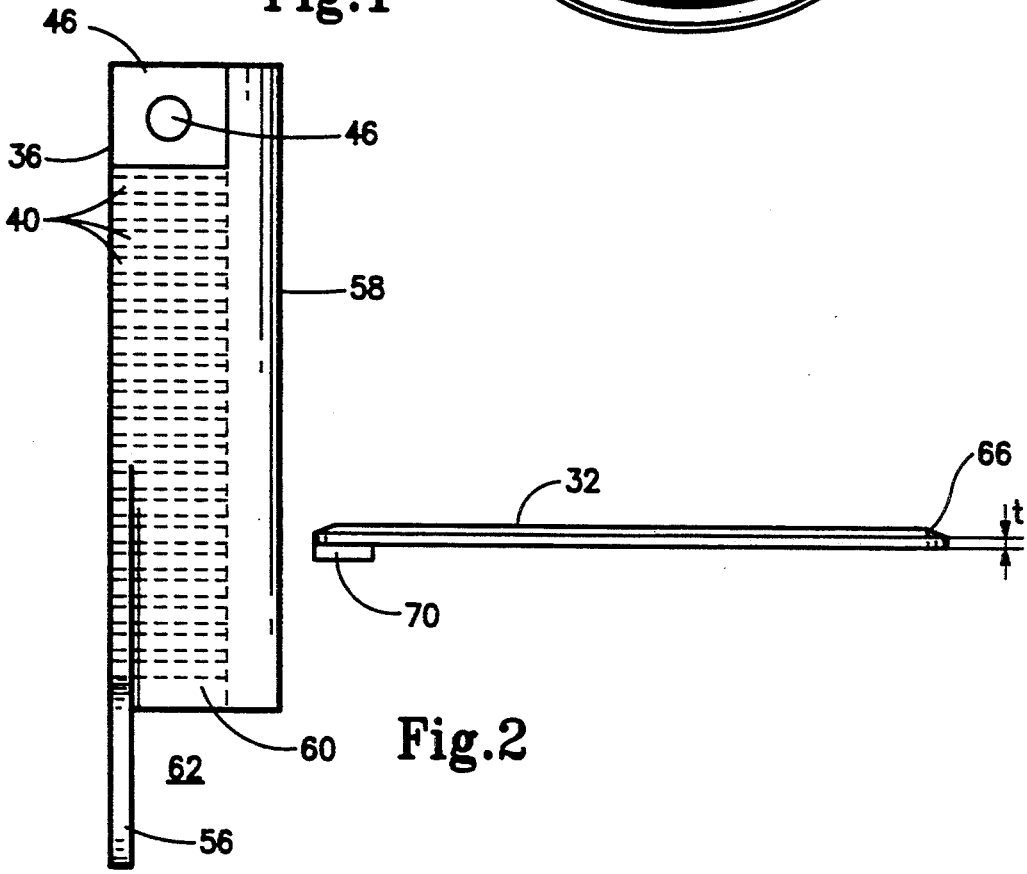
FIG. 2 is a side elevational view of a body member and a cover of the splatter guard device of the present invention shown in FIG. 1.

A splatter guard device of the present invention is adapted for use inside a cooking chamber of a conventional microwave oven to inhibit splattering of cooking foodstuffs about the cooking chamber. The splatter guard device of the present invention comprises a cover and a support structure to retain the cover in a horizontal position over an open container of foodstuffs cooking within the cooking chamber of the microwave oven. It is intended that the cover either completely or substantially covers the open container of foodstuffs cooking within the cooking chamber of the microwave oven to inhibit splattering thereof about the cooking chamber. One of ordinary skill in the art will appreciate that the present invention can also be employed to cover cooking foodstuffs setting on plates, a conventional spill tray or the floor of the cooking chamber of the microwave oven without directly contacting the foodstuffs.

As illustrated in FIGS. 1–4, a first exemplary embodiment of a splatter guard device 10 of the present invention is adapted for use within a cooking chamber 12 of a conventional microwave oven 14 to inhibit splattering of foodstuffs 15 cooking in an open container 16 disposed within cooking chamber 12. Cooking chamber 12 is defined by a rear wall 18, two opposing side walls 20 and 22, an inner door surface 24 of a front door 26, a floor 28 and a ceiling 30. As with any conventional microwave oven 14, when cooking occurs, the front door 26 is in the closed position. Splatter guard device 10 comprises a cover 32 and a support structure 34 which includes a body member 36 and a pair of arms 38. Both cover 32 and support structure 34 are fabricated from a material transparent to microwaves. Cover 32 is sized to extend longitudinally and laterally within cooking chamber 12 of microwave oven 14 to at least cover the cooking foodstuffs 15. Support structure 34 is adapted to be secured in a manner within cooking chamber 12 of the microwave oven 14 so that support structure 34 is operative to releasably retain cover 32 above and proximate to the cooking foodstuffs 15 to inhibit splattering of cooking foodstuffs 15 about cooking chamber 12.

Figure 3:
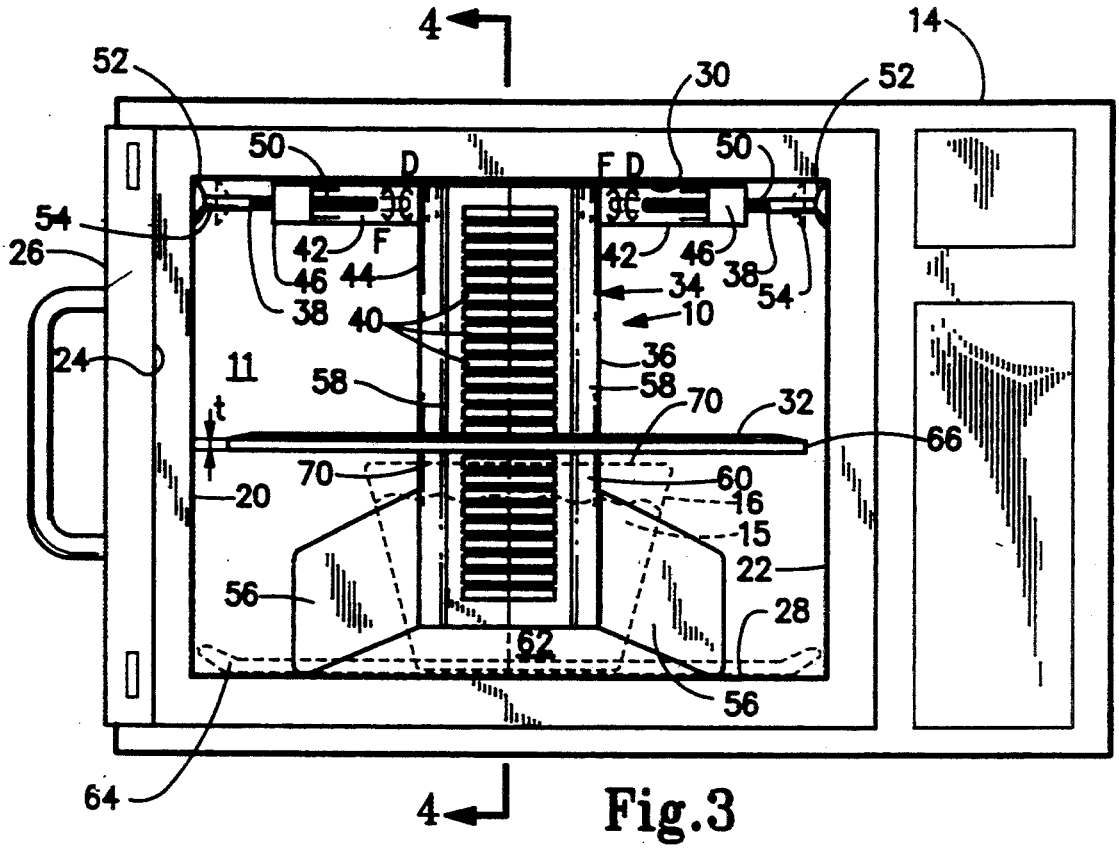
FIG. 3 is a front elevational view of the splatter guard device of the present invention in FIGS. 1 and 2 shown mounted within a cooking chamber of a microwave oven.
Figure 4:
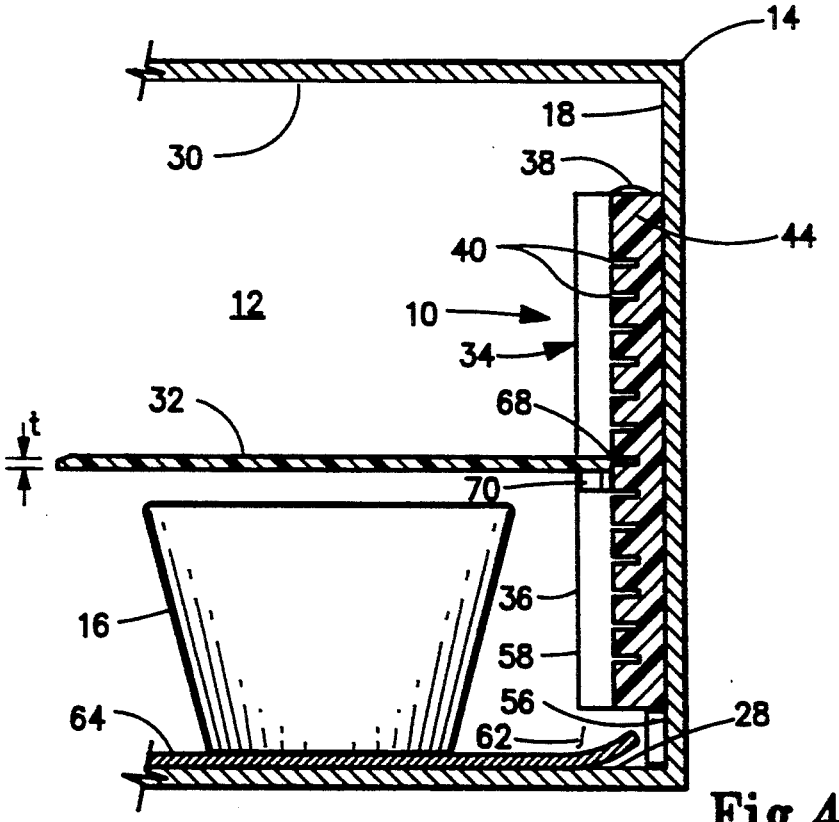
FIG. 4 is a side elevational view in cross-section of the splatter guard device of the present invention shown along line 4—4 in FIG. 3 and mounted within the cooking chamber of the microwave oven to cover an open container setting on a conventional microwave spill tray.

With reference to FIGS. 3 and 4, body member 36 extends substantially between floor 28 and ceiling 30 of cooking chamber 12 of microwave oven 14 and is adapted to abut rear wall 18 of cooking chamber 12 of microwave oven 14. Body member 36 is formed with an array of slots 40 extending laterally and substantially parallel to each other and facing cooking chamber 12. Body member 36 includes a pair of shoulders 42 projecting from and connected to an upper portion 44 of body member 36 to define a T-shape. Each of shoulders 42 is adapted to matably receive a respective one of arms 38. Each of shoulders 42 also has a pair of end portions 46 having a threaded hole 48 extending therethrough. As best shown in FIGS. 1 and 3, each of arms 38 includes a threaded shaft 50 and a cup element 52 connected to a distal end 54 of threaded shaft 50. Each of threaded shafts 50 is formed to matably engage a respective one of threaded holes 48 of end portions 46 of shoulders 42. Upon rotating each arm 38 in a fastening direction "F", each arm 38 extends into an anchoring position whereby each cup element 52 engages a respective one of opposing side walls 20 and 22. Upon rotating each arm 38 in a detaching direction "D", which is a direction opposite of fastening direction "F", arms 38 retract into a detached position thereby disengaging cup elements 52 from respective opposing side walls 20 and 22 as shown in phantom in FIG. 3. In the detached position, support structure 34 can be either removed from or placed into cooking chamber 12 of microwave oven 14. For purposes of first exemplary embodiment of the present invention, body member 36 is constructed as a unitary piece.

Body member 36 also includes a pair of legs 56 and a pair of pillar portions 58. Pair of legs 56 are connected to a lower portion 60 of body member 36 and are adapted to elevate body member 36 above floor 28 within cooking chamber 12. Legs 56 are also adapted to abut rear wall 18 within cooking chamber 12 as shown in FIG. 4. Additionally, legs 56 are sized to provide an opened space 62 underneath body member 36 to minimize any interference that support structure 34 might cause with inserting microwave accessories such as a conventional spill tray 62 into cooking chamber 12. One of ordinary skill in the art would appreciate that this feature of opened space 62 underneath body member 36 also minimizes interference with other types of microwave accessories such as microwave carrousels which might be substituted for conventional spill tray 62. Pair of pillar portions 58 project into cooking chamber 12 toward inner door surface 24 and extend vertically along body member 36. Each of pillar portions 58 is disposed on opposite sides of array of slots 40 to form a tapering guide for inserting cover 32 into a select one of array of slots 40.

Cover 32 having a thickness "t" is substantially flat and extends longitudinally and laterally within the cooking chamber 12 of microwave oven 14 to terminate in an outer peripheral edge portion 66. When inserted into cooking chamber 12, outer peripheral edge portion 66 of cover 32 is disposed proximate to rear wall 18, two opposing side walls 20 and 22 and inner door surface 24 of front door 26, as best shown in FIG. 3. Outer peripheral edge portion 66 is adapted to be releasably retained by support structure 34. As a result, cover 32 includes a tongue element 68 projecting outwardly from outer peripheral edge portion 66 and is operable to be removably inserted into support structure 34 so that cover 32 is disposed substantially horizontally within cooking chamber 12 of microwave oven 14. More specifically, tongue element 68 is operative to be releasably inserted into a select one of array of slots 40. Cover 32 also includes a pair of bracing segments 70 which are adapted to contact a respective one of pillar portions 58 when tongue element 68 of cover 32 is inserted into a select one of array of slots 40. Bracing segments 70 are adapted to assist in supporting cover 32 onto body member 36 along pillar portions 58. For purposes of the first exemplary embodiment of the present invention, cover 32 is a unitary piece.

With reference to FIG. 3, pair of arms 38 are oppositely disposed on and movably connected to upper portion 44 of body member 36 and are operative to move between the detached position, shown in phantom, and the anchor position. In the detached position, body member 36 is detached from respective opposite side walls 20 and 22 by retracting pair of arms 38 from contact with respective side walls 20 and 22 within cooking chamber 12. In the anchor position, body member 36 is mounted within cooking chamber 12 by extending pair of arms 38 in contact with respective opposite side walls 20 and 22. In the anchor position, cover 32 can be releasably inserted into a select one of array of slots 40 to retain cover 32 in a substantially horizontal position above and proximate to the open container 16 of cooking foodstuffs 15 to inhibit splattering of the cooking foodstuffs 15 about cooking chamber 12.

Cover 32 can be moved vertically within cooking chamber 12 simply by withdrawing cover 32 from support structure 34 and inserting tongue element 68 into any select slot 40 so that cover 32 can be moved vertically within cooking chamber 12 in a horizontal position to a select location i.e., where slots 40 are located. Being capable of moving cover 32 vertically within cooking chamber 12 facilitates covering a variety of open containers having different sizes. Furthermore, while the open container is temporarily removed from cooking chamber 12, cover 32 can remain in place therewithin.

Figure 5:
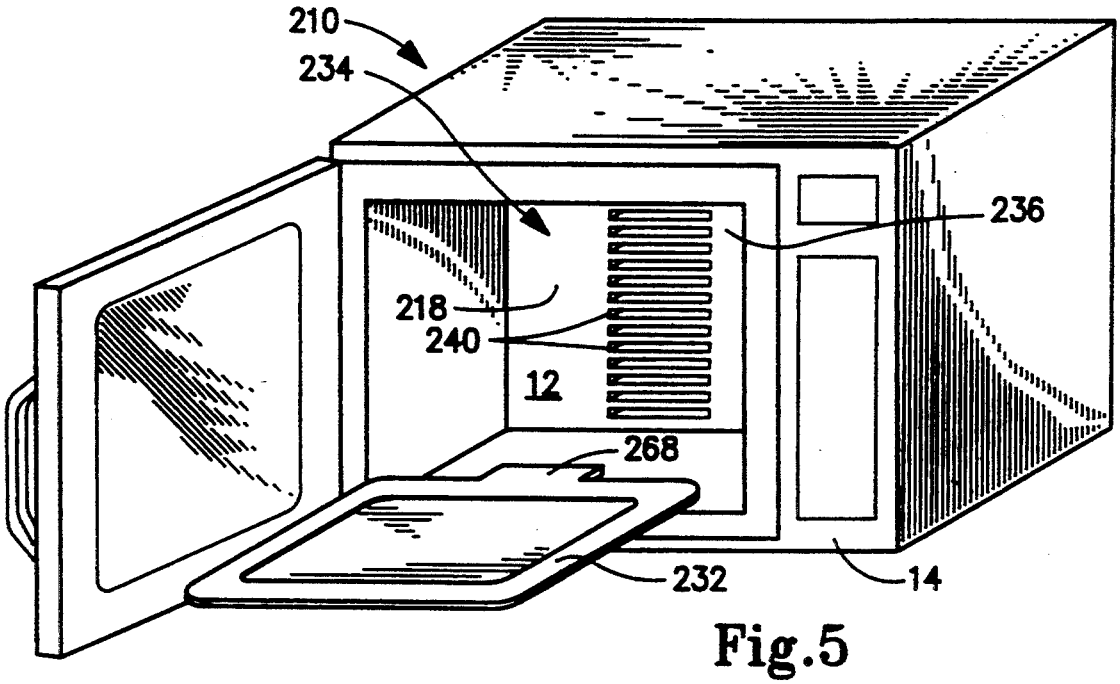
FIG. 5 is an exploded perspective view of a second exemplary embodiment of a splatter guard device of the present invention having a cover positioned to enter a cooking chamber of a microwave oven.
Figure 6:
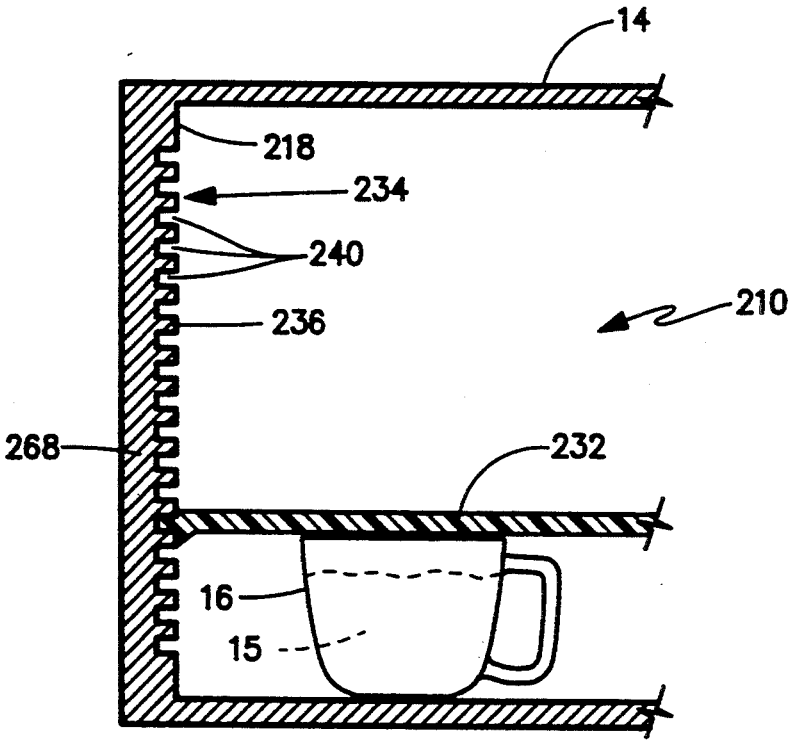
FIG. 6 is a side view in cross-section of the splatter guard device shown in FIG. 5 having the cover releasably inserted into a selected slot formed into a rear wall of a microwave oven to cover an open container.

A second exemplary embodiment of a splatter guard device 210 of the present invention is shown in FIGS. 5 and 6. Splatter guard device 210 includes a cover 232 and a support structure 234. Support structure 234 includes a body member 236 having an array of slots 240 extending laterally and substantially parallel to each other and facing into cooking chamber 12 of microwave oven 14. For the second exemplary embodiment, body member 236 is a rear wall 218 within cooking chamber 12 of microwave oven 14 that is formed with array of slots 240. Cover 232 includes a tongue element 268 which is releasably inserted into a select one of array of slots 240, as shown in FIG. 6, to retain cover 232 in a substantially horizontal position above and proximate to the open container 16 of cooking foodstuffs 15 to inhibit splattering of the cooking foodstuffs 15 about cooking chamber 12.

Figure 7:
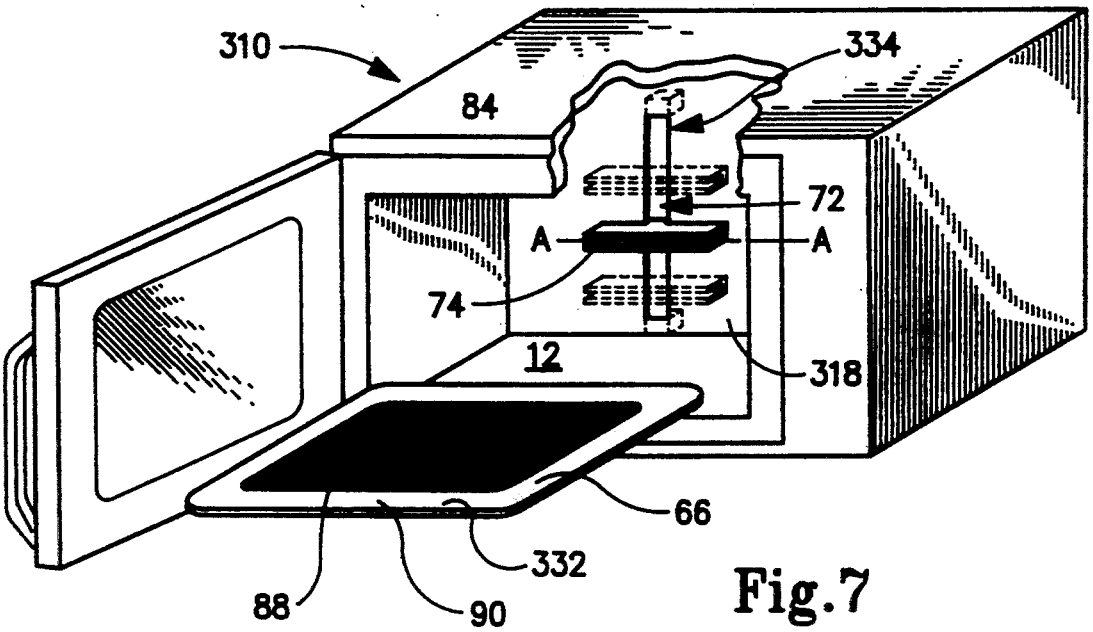
FIG. 7 is an exploded perspective view of a third exemplary embodiment of a splatter guard device of the present having a cover positioned to enter a cooking chamber of a microwave oven.
Figure 8:
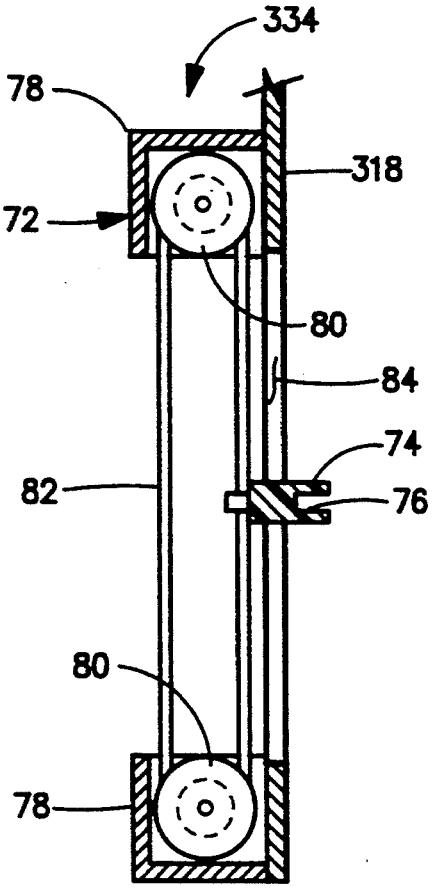
FIG. 8 is a side view in cross-section of a belt and pulley assembly as a support structure for the third exemplary embodiment of the splatter guard device shown in FIG. 7.
Figure 9:
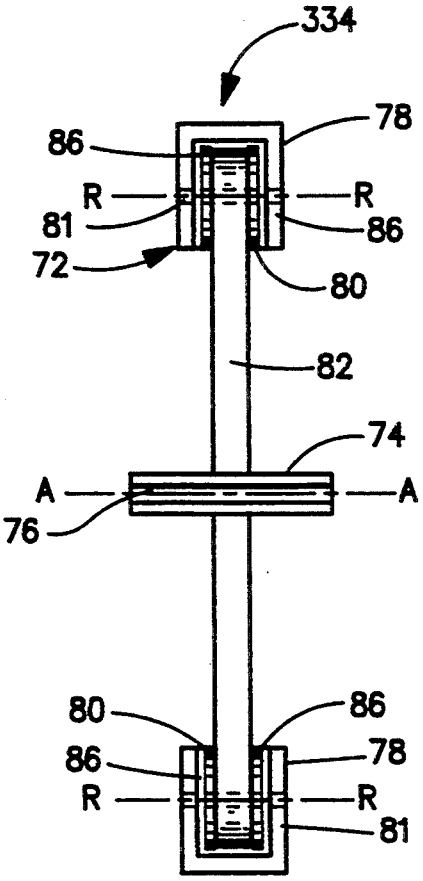
FIG. 9 is a front elevational view of the belt and pulley assembly shown in FIG. 8.

A third exemplary embodiment of a splatter guard device 310 of the present invention is shown in FIGS. 7–9. Splatter guard device 310 includes a cover 332 and a support structure 334. 21. Support structure 334 is mounted within cooking chamber 12 includes a belt and pulley assembly 72 having a U-shaped retaining element 74 connected thereto. U-shaped retaining element 74 has a U-shaped channel 76 facing cooking chamber 12 with a channel axis "A" extending through U-shaped channel 76. Channel axis "A" of U-shaped channel 76 is oriented in a substantially parallel relationship with respect to either the floor or the ceiling within cooking chamber 12. U-shaped channel 76 is sized to releasably receive outer peripheral edge portion 66 of cover 332 to retain cover 332 to U-shaped retaining element 74. U-shaped retaining element 74 of belt and pulley assembly 72 is operative to move vertically within cooking chamber 12 so that cover 332 may extend horizontally within cooking chamber 12 over cooking foodstuffs to inhibit splattering of the cooking foodstuffs about cooking chamber 12.

Belt and pulley assembly 72 includes a pair of mounting blocks 78, a pair of pulleys 80 and a continuous belt 82 operably interconnecting pulleys 80. Each mounting block 78 has a respective pulley 80 rotatably mounted thereto by a shaft 81 enabling respective pulleys 80 to rotate about a respective axis of rotation "R". Continuous belt 82 is connected to said U-shaped retaining element 74 so that when cover 332 is releasably retained by U-shaped retaining element 74, cover 332 can be moved vertically within cooking chamber 12 in a horizontal position to a select location between said pulleys to cover cooking foodstuffs.

Although not by way of limitation, belt and pulley assembly 72 is mounted behind a rear wall 318 within cooking chamber 12. Rear wall 318 is formed with a rear wall slot 84 so that the U-shaped retaining element 74 can be disposed into cooking chamber 12 while being connected to continuous belt 82 and vertically movable between pulleys 80. Belt and pulley assembly 72 includes two pair of friction pads 86. Each pair of friction pads 86 are mounted onto respective shafts 81 and are disposed between each pulley 80 and each mounting block 78 as best shown in FIG. 9. Although at least one friction pad 86 disposed between each pulley 80 and each mounting block 78 would be sufficient, friction pads 86 are operative to prevent rotational movement of the pair of pulleys 80 when cover 332 is releasably retained by U-shaped retaining element 74 in its horizontal position at a select vertical location between the pair of pulleys 80.

For purposes of the third exemplary embodiment of the present invention and not by way of limitation, cover 332 includes an inner flexible panel 88 surrounded by and connected to a rigid outer frame structure 90. Outer frame structure 90 adapted to be releasably retained by U-shaped retaining element 74 of support structure 334. Inner flexible panel 88 can be screen material which is transparent to microwaves or paper material such a paper towel material. One of ordinary skill in the art would appreciate that the paper towel material would be removable from and replaceable within outer frame structure 90 and that the screen material would be of a type that is washable.

Having the capability of moving cover 332 to any vertical location within cooking chamber 12 between pulleys 80, cover 332 can be horizontally positioned above and proximate to the open container to inhibit splattering of cooking food particles or cover 332 can be positioned directly on top of and in contact with the open container to prevent any splattering of cooking food particles. This capability affords splatter guard device 310 to cover a variety of open containers having different sizes.

From the description of the exemplary embodiments, one of ordinary skill in the art would appreciate that the splatter guard device of the present invention can cover a variety of open containers including plates that are currently being employed to cook food in a microwave oven. The cover can be retained above and proximate to the open container or it can be retained directly in contact on the open container, if desired. When covering plates of food cooking in the microwave oven, the cover can avoid contact with the food or, if desired, the cover can contact the food. By avoiding contact with the food, there is no need to wash or change the cover if a different plate of food is to be cooked immediately thereafter. Also, food can be placed directly onto the floor within the cooking chamber or onto a microwave accessory and covered by the present invention to inhibit splattering of food particles about the cooking chamber. Further, the splatter guard device of the present invention can be employed into future models of microwave ovens or it can be easily retrofitted into existing microwave ovens without making any physical modifications thereto.

Accordingly, the present invention has been described with some degree of particularity directed to exemplary embodiments of the present invention. It should be appreciated, though, that the present invention is defined by the following claims construed in light of the prior art so that modifications or changes may be made to the exemplary embodiments without departing from the inventive concepts contained herein.

I claim:

1. A splatter guard device adapted for use within a cooking chamber of a conventional microwave oven to inhibit splattering of foodstuffs cooking in an open container disposed therewithin, the cooking chamber defined by a rear wall, two opposing side walls, an inner door surface of a closed front door, a floor and a ceiling, comprising:

(a) a body member fabricated from a material transparent to microwaves, said body member extending substantially between the floor and the ceiling of the cooking chamber of the microwave oven and adapted to abut the rear wall thereof, said body member formed with an array of slots extending laterally and substantially parallel to each other and facing the cooking chamber;

(b) a substantially flat cover fabricated from a material transparent to microwaves, said cover extending longitudinally and laterally within the cooking chamber of the microwave oven and terminating in an outer peripheral edge portion disposed proximate to the rear wall, the two opposing side walls and the inner door surface of the closed front door; and (c) a pair of arms oppositely disposed on and movably connected to an upper portion of said body member, said pair of arms operative to move between a detached position whereby said body member is detached from said respective opposite side walls by retracting said pair of arms from contact with the respective side walls within the cooking chamber and an anchor position whereby said body member is mounted within the cooking chamber by extending said pair of arms in contact with respective opposite side walls so that, in the anchor position, said cover can be releasably inserted into a select one of said plurality of slots to retain said cover in a substantially horizontal position above and proximate to the open container of cooking foodstuffs to inhibit splattering of the cooking foodstuffs about the cooking chamber.

2. A splatter guard device according to claim 1 including a pair of shoulders projecting from and connected to an upper portion of said body member to define a T-shape, each of said shoulders adapted to matably receive a respective one of said arms.

3. A splatter guard device according to claim 2 including a pair of opposite end portions connected to a respective shoulder, each end portion having a threaded hole extending therethrough and wherein each of said arms includes a threaded shaft and a cup element connected to a distal end of said threaded shaft, each of said threaded shafts formed to matably engage a respective one of said threaded holes of said end portions of said shoulders so that, upon rotating said arms in a fastening direction, said arms extend into the anchoring position whereby each of said cup elements engage a respective one of said opposing side walls and, upon rotating said arms in a detaching direction opposite the fastening direction, said arms retract into the detached position thereby disengaging said cup elements from respective opposite side walls.

4. A splatter guard device according to claim 1 including a pair of legs connected to a lower portion of said body member and adapted to elevate said body member above said floor within the cooking chamber.

5. A splatter guard device according to claim 1 including a pair of pillar portions projecting into the cooking chamber toward said inner door surface and extending vertically along said body member, each of said pillar portions disposed on opposite sides of said array of slots and operative to contact a bracing segment of said peripheral edge portion of said cover.

6. A splatter guard device according to claim 1 wherein including a tongue element projecting outwardly from said outer peripheral edge portion of said cover and adapted to be releasably inserted into a select one of said array of slots.

7. A splatter guard device according to claim 1 wherein said body member is constructed as a unitary piece.

8. A splatter guard device adapted for use within a cooking chamber of a conventional microwave oven to inhibit splattering of foodstuffs cooking in an open container disposed therewithin, the cooking chamber defined by a rear wall, two opposing side walls, an inner door surface of a closed front door, a floor and a ceiling, comprising:

(a) a substantially flat cover fabricated from a material transparent to microwaves, said cover extending longitudinally and laterally within the cooking chamber of the microwave oven and terminating in an outer peripheral edge portion disposed adjacent to the rear wall, the two opposing side walls and the inner door surface; and (b) a support structure mounted within the cooking chamber, said support structure including a belt and pulley assembly having a U-shaped retaining element connected thereto, said U-shaped retaining element having a U-shaped channel facing the cooking chamber and having a channel axis extending through said U-shaped channel and being oriented in a substantially parallel relationship with respect to one of the floor and the ceiling, said U-shaped channel sized to releasably receive said peripheral edge portion of said cover to retain said cover to said U-shaped retaining element, said U-shaped retaining element of said belt and pulley assembly operative to move vertically within the cooking chamber so that said cover may extend horizontally within the cooking chamber over the cooking foodstuffs to inhibit splattering of the cooking foodstuffs about the cooking chamber.

9. A splatter guard device according to claim 8 wherein said belt and pulley assembly includes a pair of mounting blocks, a pair of pulleys and a continuous belt operably interconnecting said pulleys, each of said mounting blocks having a respective pulley rotatably connected thereto about respective axis of rotation, said continuous belt connected to said U-shaped retaining element so that when said cover is releasably retained by said U-shaped retaining element, said cover can be moved vertically within the cooking chamber in a horizontal position to a select location between said pulleys.

10. A splatter guard device according to claim 9 wherein said belt and pulley assembly is mounted behind the rear wall and wherein said rear wall includes a rear wall slot so that the U-shaped retaining element can be disposed into said cooking chamber while being connected to said belt behind said rear wall slot and vertically movable between said pulleys.

11. A splatter guard device according to claim 10 including at least one friction pad disposed between said pulley and said mounting block of said belt and pulley assembly, said friction pad operative to prevent rotational movement of said pair of pulleys when said cover is releasably retained by said U-shaped retaining element in the horizontal position at the select vertical location between said pair of pulleys.

* * * * *